US008037571B2

(12) United States Patent
Butts et al.

(10) Patent No.: US 8,037,571 B2
(45) Date of Patent: Oct. 18, 2011

(54) VACUUM CLEANER ACCESSORY TOOL HAVING A REMOVABLE BRUSH

(75) Inventors: Mark Butts, Akron, OH (US); Doug Rukavina, Massillon, OH (US)

(73) Assignee: Techtronic Floor Care Technology Limited (VG)

( * ) Notice: Subject to any disclaimer, the term of this patent is extended or adjusted under 35 U.S.C. 154(b) by 0 days.

(21) Appl. No.: 12/552,158

(22) Filed: Sep. 1, 2009

(65) Prior Publication Data

US 2011/0047746 A1 Mar. 3, 2011

(51) Int. Cl.
*A47L 5/10* (2006.01)
*A47L 5/26* (2006.01)

(52) U.S. Cl. ..... 15/383; 15/389; 15/392

(58) Field of Classification Search ..... 15/383–392
See application file for complete search history.

(56) References Cited

U.S. PATENT DOCUMENTS

| | | | | | |
|---|---|---|---|---|---|
| 1,355,978 | A | * | 10/1920 | Jackson | 15/182 |
| 1,624,251 | A | * | 4/1927 | Keefer | 15/368 |
| 1,783,205 | A | * | 12/1930 | White | 15/392 |
| 2,092,581 | A | | 9/1937 | Kitto | |
| 2,170,963 | A | | 8/1939 | Dahl | |
| 2,226,581 | A | * | 12/1940 | Richardson | 15/41.1 |
| 2,317,570 | A | * | 4/1943 | White | 15/392 |
| 2,707,792 | A | * | 5/1955 | Waller | 15/182 |
| 2,785,431 | A | | 3/1957 | Pardee | |
| 2,880,446 | A | | 4/1959 | Muller | |
| 2,910,721 | A | * | 11/1959 | Burrage | 15/342 |
| 3,013,294 | A | | 12/1961 | Ostrom | |
| 3,671,996 | A | * | 6/1972 | Gaudry | 15/368 |
| 3,959,847 | A | * | 6/1976 | Kaulig et al. | 15/368 |
| 4,336,628 | A | | 6/1982 | Bradshaw et al. | |
| 4,564,972 | A | | 1/1986 | Varin | |
| 5,347,679 | A | | 9/1994 | Saunders et al. | |
| 5,373,598 | A | | 12/1994 | Weber et al. | |
| 6,065,183 | A | | 5/2000 | Hammeken et al. | |
| 6,256,832 | B1 | | 7/2001 | Dyson | |
| 6,324,714 | B1 | | 12/2001 | Walz et al. | |
| 6,345,408 | B1 | | 2/2002 | Nagai et al. | |
| 6,424,714 | B1 | | 7/2002 | Wasilewski et al. | |
| 6,519,810 | B2 | | 2/2003 | Kim | |
| 6,581,974 | B1 | | 6/2003 | Ragner et al. | |
| 6,711,777 | B2 | | 3/2004 | Frederick et al. | |
| 6,991,262 | B1 | | 1/2006 | Ragner | |

(Continued)

FOREIGN PATENT DOCUMENTS

JP 10127542 A 5/1998

(Continued)

*Primary Examiner* — Bryan R Muller
(74) *Attorney, Agent, or Firm* — Micheal Best & Friedrich LLP

(57) ABSTRACT

A vacuum cleaner accessory tool for use with a vacuum cleaner. The accessory tool includes a nozzle body defining a chamber. An agitator having a first end portion and a second end portion is rotatably supported within the chamber of the nozzle body, and the agitator is removably coupled to the nozzle body. A drive member is coupled to the agitator, and a release member is coupled to the nozzle body and slidable with respect to the nozzle body between an engaged position and a disengaged position. In the engaged position, the release member engages the second end portion of the agitator to couple the agitator to the nozzle body within the chamber. In the disengaged position, the release member allows the agitator to be removed from the chamber of the nozzle body.

20 Claims, 7 Drawing Sheets

U.S. PATENT DOCUMENTS

| | | | | |
|---|---|---|---|---|
| 7,131,164 | B2 | 11/2006 | Uratani et al. | |
| 7,146,682 | B2 | 12/2006 | Damman et al. | |
| 7,200,893 | B2 | 4/2007 | Gerber et al. | |
| 7,225,503 | B1 | 6/2007 | Lenkiewicz et al. | |
| 7,278,181 | B2 | 10/2007 | Harris et al. | |
| 7,316,050 | B2 * | 1/2008 | Worwag | 15/328 |
| 2004/0148731 | A1 | 8/2004 | Damman et al. | |
| 2008/0040883 | A1 | 2/2008 | Beskow et al. | |
| 2008/0178419 | A1 * | 7/2008 | Courtney et al. | 15/363 |

FOREIGN PATENT DOCUMENTS

WO WO 2008091199 A1 * 7/2008

* cited by examiner

VACUUM CLEANER ACCESSORY TOOL HAVING A REMOVABLE BRUSH

BACKGROUND

The present invention relates to vacuum cleaner accessory tools.

Vacuum cleaners are often supplied with multiple accessory tools. For example, in one type of vacuum, an upright vacuum, the vacuum includes a foot or main nozzle that is in fluid communication with a dirt cup and the dirt cup is in fluid communication with a fan that is operable to generate a suction air flow through the foot and the dirt cup. The main nozzle often includes a brush roll or agitator and the user moves the main nozzle along a surface to be cleaned, typically carpet or other types of flooring. The main nozzle and the dirt cup can be fluidly coupled by a suction hose that is in fluid communication with the fan. An end of the suction hose is often removably coupled to the main nozzle. The user can uncouple this end of the hose from the main nozzle and attach an accessory tool for cleaning furniture, stairs, or other areas where it is not convenient to use the main nozzle.

SUMMARY

In one embodiment, the invention provides a vacuum cleaner accessory tool for use with a vacuum cleaner. The vacuum cleaner is operable to draw air through a suction hose to clean a surface. The accessory tool includes a nozzle body configured to be coupled to the suction hose and defining a chamber. The accessory tool further includes an agitator having a first end portion and a second end portion rotatably supported within the chamber of the nozzle body, and the agitator is removably coupled to the nozzle body. A drive member is coupled to the agitator, and a release member is coupled to the nozzle body and slidable with respect to the nozzle body between an engaged position and a disengaged position. In the engaged position, the release member engages the second end portion of the agitator to couple the agitator to the nozzle body within the chamber. In the disengaged position, the release member allows the agitator to be removed from the chamber of the nozzle body.

In another embodiment the invention provides a vacuum cleaner accessory tool for use with a vacuum cleaner. The vacuum cleaner is operable to draw air through a suction hose to clean a surface. The accessory tool includes a nozzle body configured to be coupled to the suction hose and defining a chamber. The accessory tool further includes an agitator having a first end portion and a second end portion rotatably supported within the chamber of the nozzle body, and the agitator is removably coupled to the nozzle body. A drive member is coupled to the agitator and is operable to rotate the agitator. A release member is slidable with respect to the nozzle body between an engaged position and a disengaged position, and a biasing member is coupled to the release member and is configured to bias the release member toward the engaged position. In the engaged position, the release member is coupled to the nozzle body and retains the agitator in an operable position so that the agitator is drivable by the drive member. In the disengaged position, the release member is coupled to the nozzle body and the second end portion of the agitator is movable with respect to the nozzle body to uncouple the agitator from the nozzle body.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
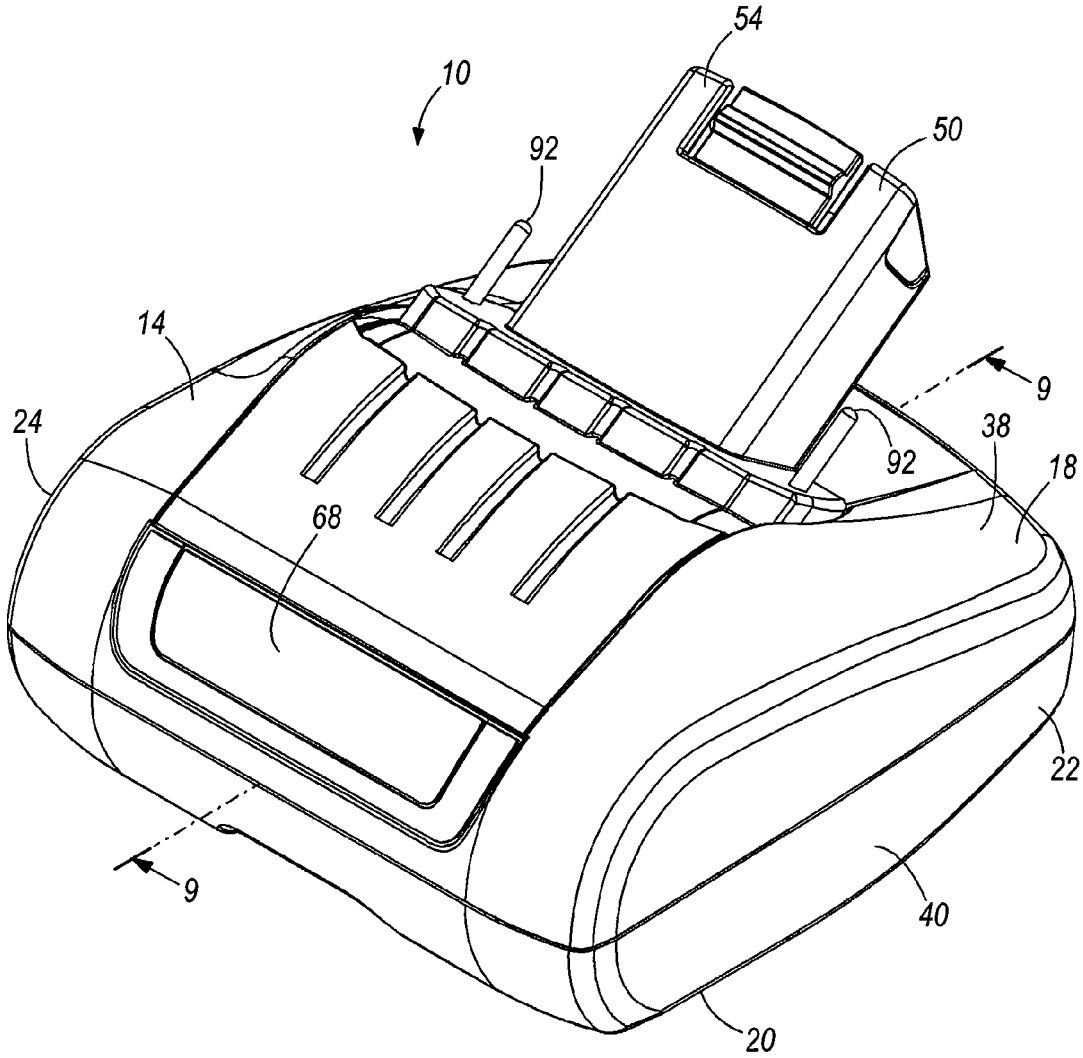
FIG. 1 is a perspective view of a vacuum cleaner accessory tool according to one embodiment of the invention.
Figure 9:
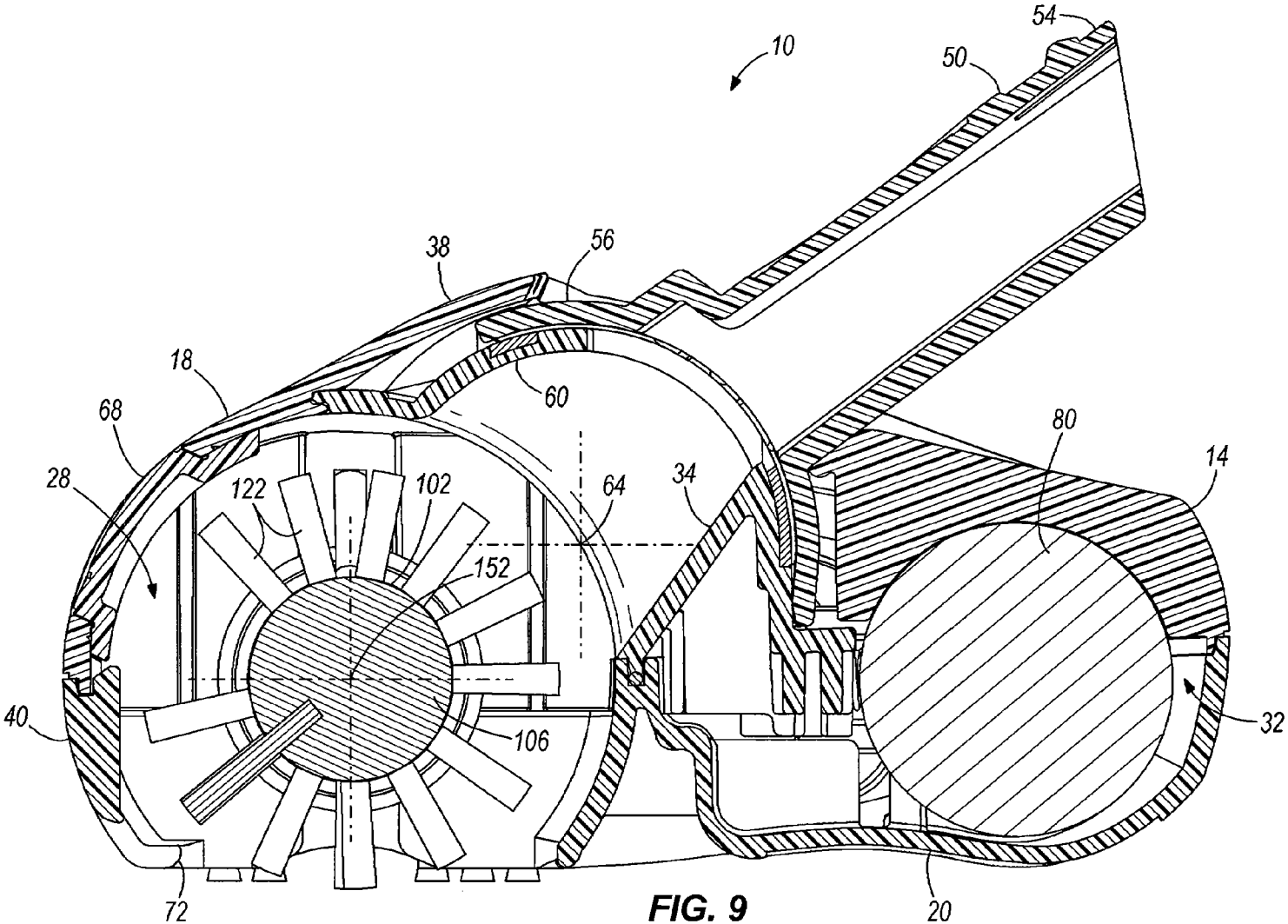
FIG. 9 is a cross-sectional view of the accessory tool of FIG. 1 taken along lines 9-9 of FIG. 1.

FIG. 1 illustrates a vacuum cleaner accessory tool 10 that can be coupled to a suction hose of a vacuum cleaner for use with the vacuum cleaner to clean or remove debris from a surface, such as upholstery, furniture, carpeting, other flooring, and the like. The accessory tool 10 includes a nozzle body 14 having a top wall 18, a bottom wall 20, a first side wall 22 that couples the top wall 18 and the bottom wall 20, and a second side wall 24 that couples the top wall 18 and the bottom wall 20 opposite the first side wall 22. Referring to FIGS. 1 and 9, portions of the walls 18, 20, 22, and 24 together partially define a front or vacuum chamber 28 and a rear chamber 32 of the nozzle body 14. Generally, the vacuum chamber 28 is separated from the rear chamber 32 by an interior wall 34 of the nozzle body 14. However, some fluid communication may exist between the chambers 28 and 32.

Figure 4:
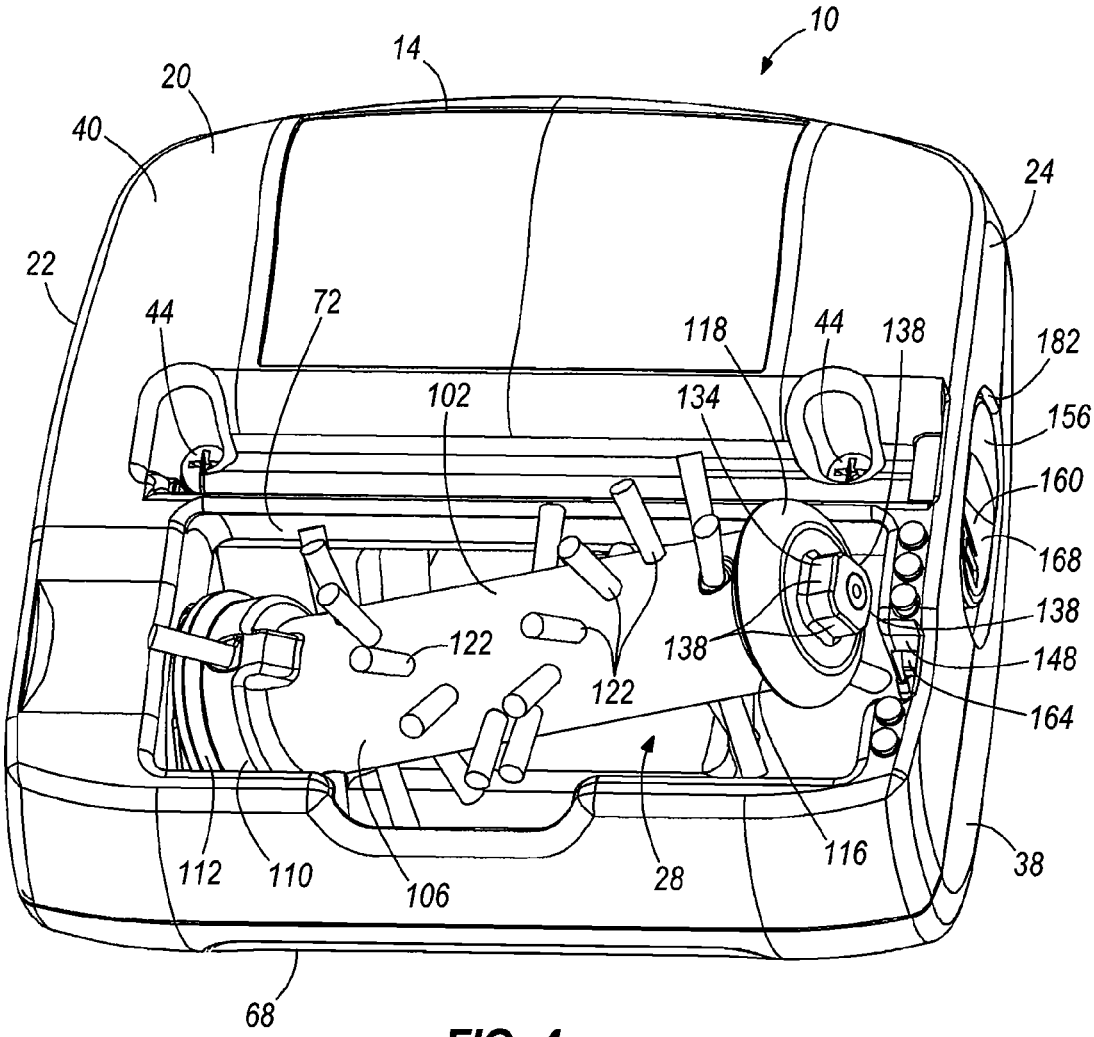
FIG. 4 is a bottom perspective view of the accessory tool of FIG. 1 illustrating the agitator being removed.
Figure 8:
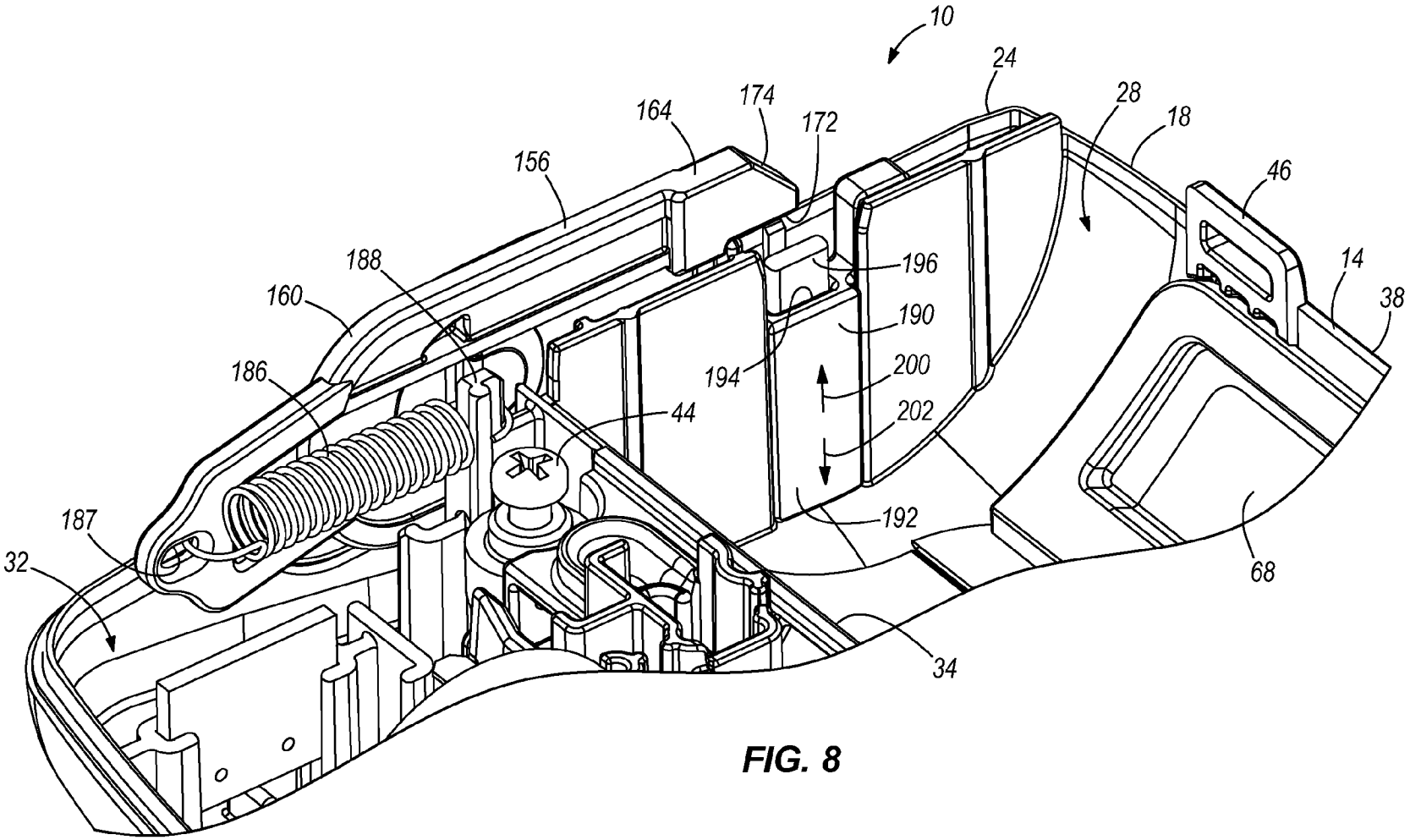
FIG. 8 is a partial bottom perspective view of the accessory tool of FIG. 1 with the agitator removed and a lower portion of a nozzle body of the accessory tool removed.

The nozzle body 14 is formed from an upper portion 38 and a lower portion 40 that are coupled together using fasteners 44 and tabs 46 in the illustrated embodiment (FIGS. 4 and 8). The upper portion 38 of the nozzle body 14 includes the top wall 18 and a portion of the side walls 22 and 24. In the illustrated embodiment, the portions of the side walls 22 and 24 of the upper portion 38 extend from the top wall 18 generally normal or perpendicular to the top wall 18.

With continued reference to FIGS. 1 and 9, an outlet conduit 50 is coupled to the upper portion 38 of the nozzle body 14 to provide fluid communication between the chamber 28 and a hose of a vacuum cleaner. In the illustrated embodiment, the outlet conduit 50 generally extends upward and rearward from the top wall 18 and the outlet conduit 50 includes a first end portion 54 and a second end portion 56. The first end portion 54 is configured to be received by the hose of the vacuum cleaner to removably couple the accessory tool 10 to the vacuum cleaner. The second end portion 56 is generally arc-shaped and is received between the top wall 18 and an interior wall 60 of the nozzle body 14 so that the outlet conduit 50 can pivot with respect to the nozzle body 14 about an axis 64 (FIG. 9). Although the illustrated outlet conduit 50 can pivot with respect to the nozzle body 14, in other embodiments, the outlet conduit 50 can be fixed with respect to the nozzle body 14 and in such embodiments, the outlet conduit can be integrally formed with the upper portion 38 of the nozzle body 14 as a single component. The upper portion 38 of the nozzle body 14 further includes a viewing window 68. The viewing window 68 allows a user of the tool 10 to look into the chamber 28.

The lower portion 40 of the nozzle body 14 includes the bottom wall 20 and a portion of the side walls 22 and 24. In the illustrated embodiment, the portions of the side walls 22 and 24 of the lower portion 40 extend from the bottom wall 20 generally normal or perpendicular to the bottom wall 20. The bottom wall 20 includes a suction inlet aperture 72 that extends through the bottom wall 20 to provide fluid communication into the vacuum chamber 28 from outside of the vacuum chamber 28.

Figure 5:
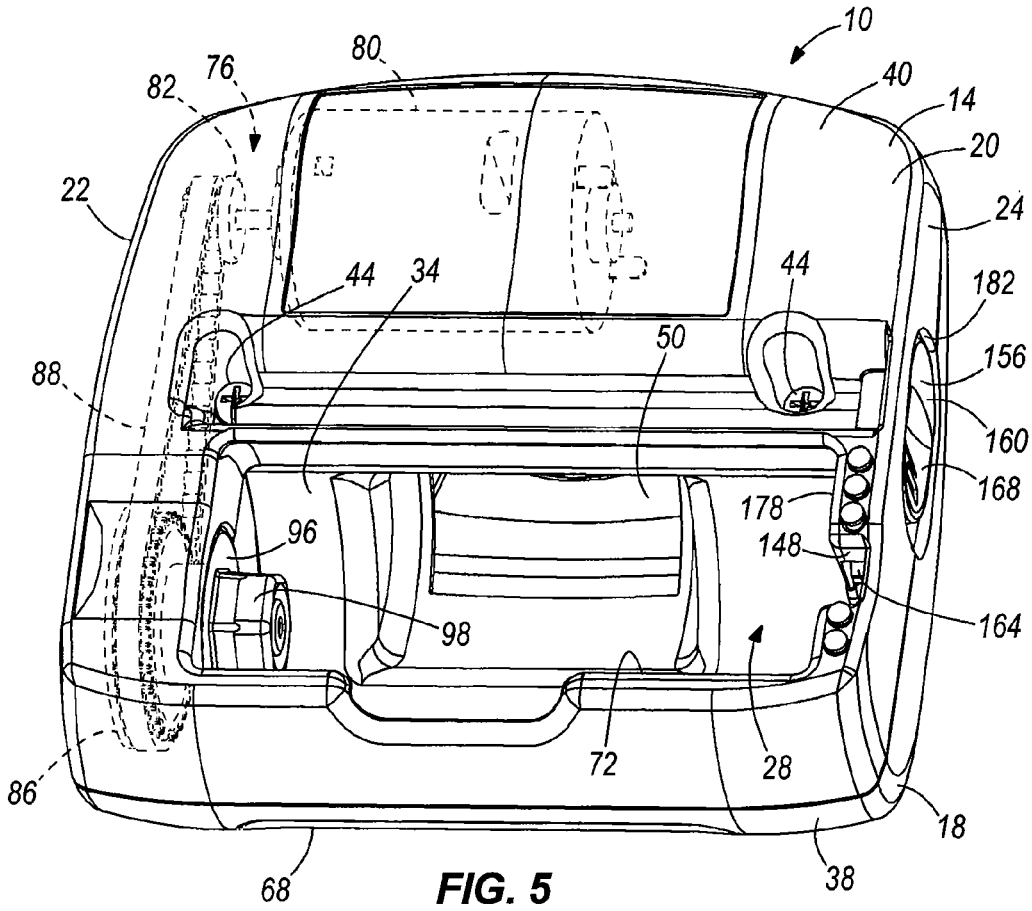
FIG. 5 is a bottom perspective view of the accessory tool of FIG. 1 with the agitator removed.

Referring to FIG. 5, the accessory tool 10 further includes a drive assembly 76. The illustrated drive assembly 76 includes a drive member or electric motor 80 having an output or drive gear 82 that is connected to a driven gear 86 by a belt 88. The electric motor 80 is electrically connected to a power source using terminals 92 (FIG. 1). The terminals 92 can be received in apertures of the suction hose that provide power to the motor 80 when the vacuum is operating. Although the illustrated drive member includes the electric motor 80, in other embodiments, other types of drive members can be used, including air turbines and the like. The drive assembly 76 further includes an output driven member 96 that is coupled to the driven gear 86 for rotation with the driven gear 86. In the illustrated embodiment, the output driven member 96 includes a hex-head 98, but in other embodiments, other suitable members can be utilized.

Figure 3:
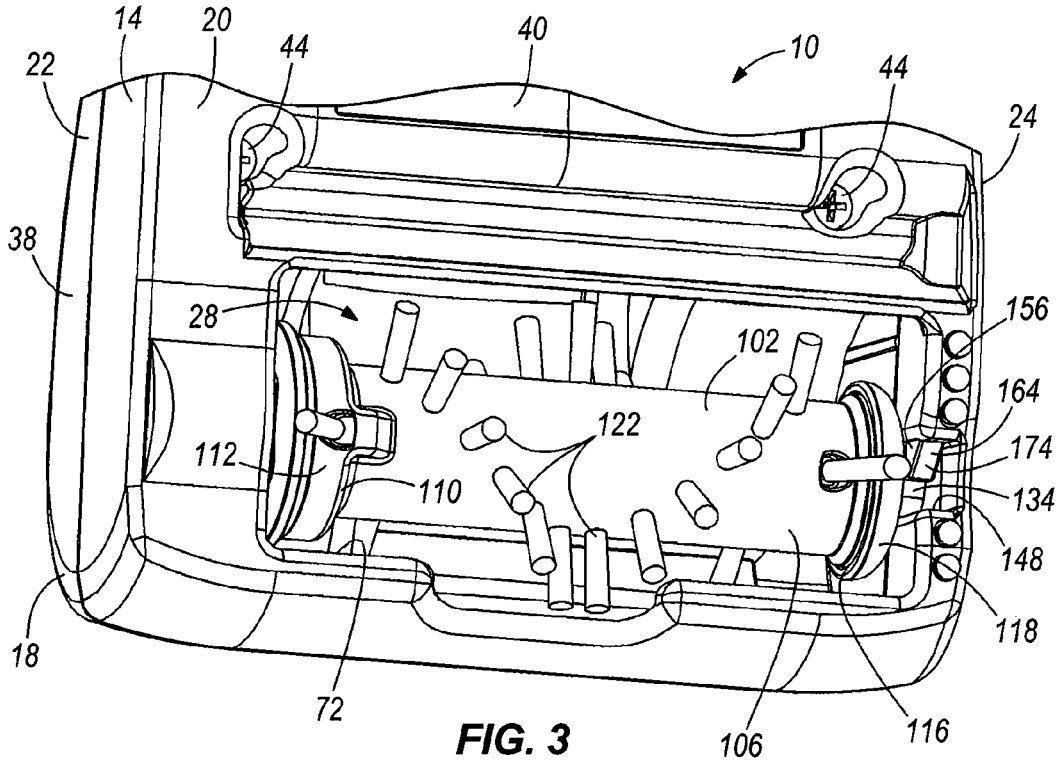
FIG. 3 is a partial bottom alternative perspective view of the accessory tool of FIG. 1.
Figure 6:
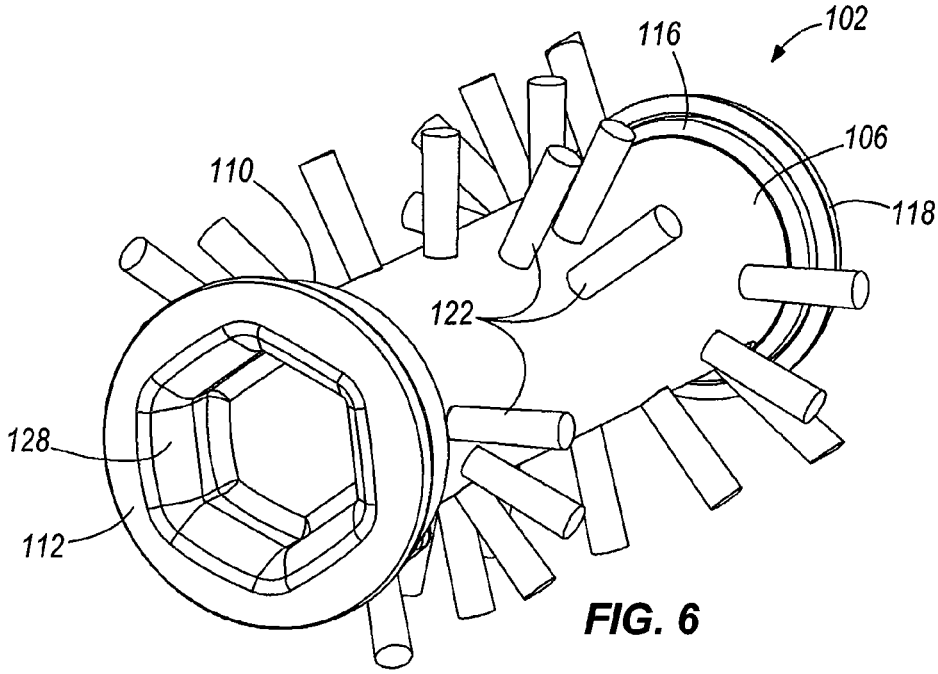
FIG. 6 is a perspective view of the agitator of the accessory tool of FIG. 1.

As best seen in FIGS. 3, 4, and 6, the accessory tool 10 further includes an agitator 102 that is removably and rotatably coupled to the nozzle body 14 and driven by the drive assembly 76. The illustrated agitator 102 includes a generally cylindrical base 106, a first end portion 110 that includes a first coupling 112, and a second end portion 116 that includes a second coupling 118. In the illustrated embodiment, brush members 122 extend radially from the base 106. The brush members 122 can be formed from nylon bristles, rubber knobs, and the like. In other embodiments, base 106 can include blades, such as resilient flexible rubber blades, alone or in combination with the brush members 122.

Figure 2:
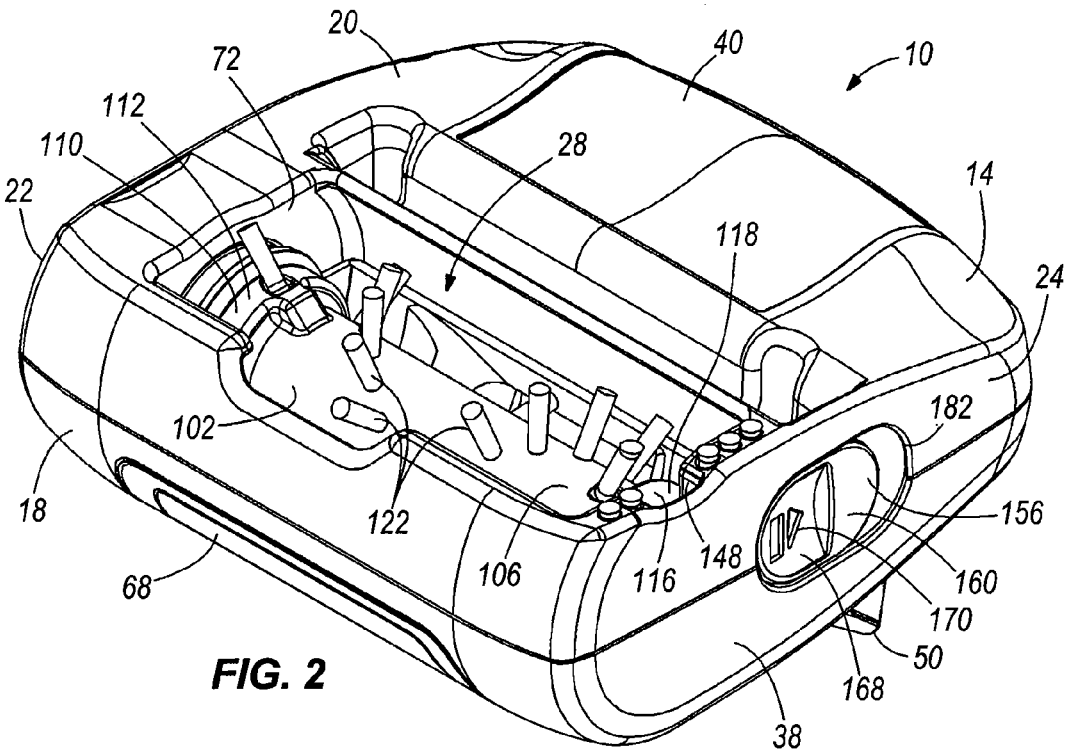
FIG. 2 is a bottom perspective view of the accessory tool of FIG. 1 illustrating an agitator of the accessory tool in an operable position.

Referring to FIGS. 5 and 6, the illustrated first coupling 112 receives an end of the base 106 to couple the coupling 112 and the base 106 for co-rotation, and the coupling 112 includes a hex-shaped recess 128. The hex-shaped recess 128 receives the hex-shaped head 98 of the driven member 96, as illustrated in FIG. 2, to couple the agitator 102 to the drive assembly 76, and therefore to transfer rotation of the driven member 96 to the agitator 102. As shown in FIG. 4, the second coupling 118 is rotatably coupled to the base 106 to allow the base 106 to rotate with respect the second coupling 118 when the coupling 118 is coupled to the nozzle body 14. The coupling 118 includes a projection 134 having four generally flat side surfaces 138 with opposed surfaces 138 being generally parallel to each other and adjacent surfaces 138 being generally perpendicular to each other.

Figure 7:
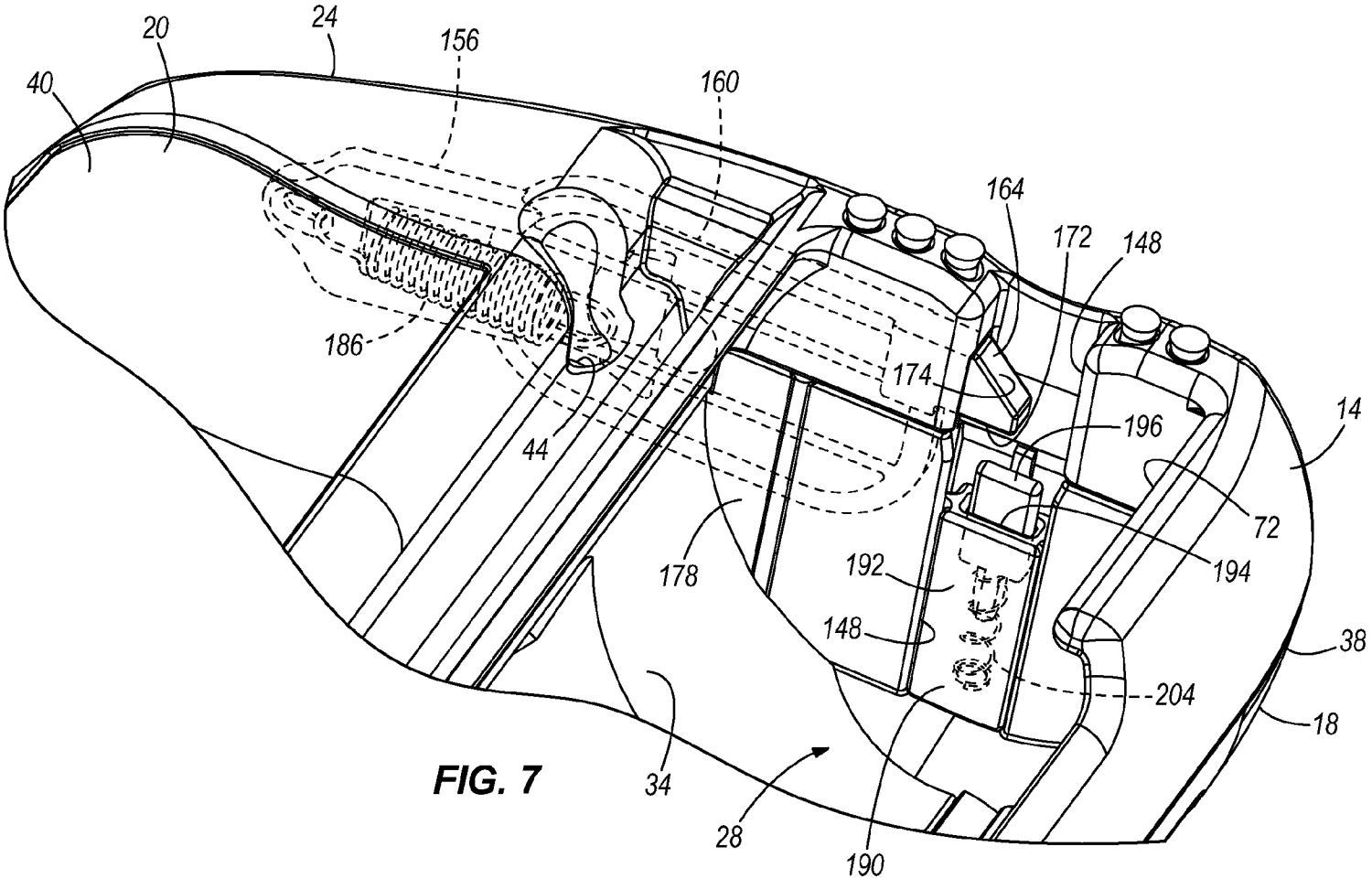
FIG. 7 is a partial bottom perspective view of the accessory tool of FIG. 1 with the agitator removed.

As best seen in FIG. 7, a generally straight and open ended slot 148 is formed in the upper portion 38 and the lower portion 40 of the nozzle body 14. As best shown in FIG. 3, the slot 148 is sized to receive the projection 134 of the coupling 118 to couple the second end portion 116 of the agitator 102 to the nozzle body 14. The slot 148 couples the coupling 118 to the nozzle body 14 so that the coupling 118 cannot rotate with respect to the body 14 and yet the base 106 is rotatable with respect to the coupling 118 so that the agitator 102 is coupled to the nozzle body 14 for rotation with respect to the nozzle body 14 about an axis 152 (FIG. 9).

The accessory tool 10 further includes an agitator release member 156 that is slidable by a user of the tool 10 from an engaged position (FIG. 3) to a disengaged position (FIG. 4) to allow the agitator 102 to be removed from the chamber 28 through the suction inlet aperture 72. Referring to FIGS. 2 and 8, the release member 156 includes an actuation portion 160 and an engagement portion 164. The actuation portion 160 includes a recess 168 configured to receive a finger of the user and indicia 170, which includes an arrow in the illustrated construction. The engagement portion 164, as illustrated in FIG. 8, includes a generally flat bottom portion 172 and a cam surface 174 opposite the flat bottom portion 172.

Referring to FIGS. 5, 7, and 8, the release member 156 is captured between the outer side wall 24 and an inner wall 178 of the nozzle body 14 such that the release member 156 can slide between the engaged and disengaged positions. Also, as illustrated in FIG. 2, the actuation portion 160 is accessible by the user through an aperture 182 through the side wall 24 of the body 14. The illustrated release member 156 is integrally formed as a single piece, and in one embodiment, is molded from plastic.

As shown in FIG. 8, a biasing member 186 is coupled to the actuator release member 156 to bias the actuator release member 156 toward the engaged position (FIG. 8). In the illustrated construction, the biasing member 186 includes a coil spring, and in other embodiments, the biasing member can include any suitable biasing member. The illustrated biasing member 186 includes a first end coupled to the release member 156 using an aperture 187 through the release member 156 and a second end coupled to a post 188 of the upper portion 38 of the nozzle body 14.

Referring to FIGS. 7 and 8, the illustrated accessory tool 10 further includes an ejection mechanism 190. The illustrated ejection mechanism 190 includes a base 192 having an aperture 194 and a slide 196 that slides or moves with respect to the base 192 in the direction of arrows 200 and 202 (FIG. 8). A biasing member 204 (FIG. 7), which is a coil spring in the illustrated construction, biases the slide 196 with respect to the base 192 in the direction of arrow 202. The base 192 is received within the slot 148 and is generally held fixed with respect to the body 14 when the upper portion 38 is coupled to the lower portion 40.

Referring to FIGS. 1 and 9, in operation, the user couples the outlet conduit 50 to a vacuum cleaner hose and when the user turns the vacuum cleaner 'on,' air is drawn through the suction inlet aperture 72, through the front chamber 28 and the outlet conduit 50 and into the vacuum. The user moves the lower portion 40 of the nozzle body 14, particularly the suction inlet aperture 72 along a surface to be cleaned to draw debris from the surface through the suction inlet aperture 72 and into the vacuum. Meanwhile, referring to FIG. 5, the motor 80 drives the output gear 82 to turn the belt 88, which turns the driven gear 86. Driving the driven gear 86 rotates the output driven member 96 to rotate the agitator 102 about the axis 152 (FIG. 9). Rotation of the agitator 102 causes the brush members 122 to contact the surface to be cleaned or agitate debris on the surface to facilitate removal of the debris.

Referring to FIG. 2, the user may desire to remove the agitator 102 to either clean or replace the agitator 102. To remove the agitator 102, the user slides the release member 156 in the direction of arrow 170 from the engage position (FIG. 3) to the disengaged position (FIG. 4). Typically, the release member 156 would be slid by using a finger to press against the recess 168 and moving the actuation portion 160 in the direction of arrow 170. Moving the release member 156 to the disengaged positions causes the engagement portion 164 of the release member 156 to move out of the slot 148 as illustrated in FIG. 4. Therefore, the flat bottom surface 172 (FIG. 7) no long holds the projection 134 of the coupling 118 within the slot 148 and the projection 134 and second end portion 116 of the agitator 102 are allowed to slide out of the slot 148 as illustrated in FIG. 4. Also, referring to FIG. 8, this movement of the projection 134 out of the slot 148 is facilitated by the slide 196 of the ejection mechanism 192 pushing on the projection 134 in the direction of arrow 200 and out of the chamber 28. With the agitator 102 in the position illustrated in FIG. 4, the first coupling 112 can easily slide off of the hex-shaped head 98 of the driven member 96.

To reconnect the agitator 102 to the nozzle body 14, the user inserts the hex-shaped head 98 of the driven member 96 into the hex-shaped recess 128 (FIG. 6) of the first coupling 112 of the agitator 102, placing the agitator 102 in the position illustrated in FIG. 4. With the agitator 102 in the position illustrated in FIG. 4, the user pivots the agitator 102 to slide the projection 134 into the slot 148 of the nozzle body 14. When the projection 134 contacts the cam surface 174 (FIG. 8) of the release member 156, the projection 134 forces the release member 156 toward the disengaged position (FIG. 4) or forces the engagement portion 164 out of the slot 148 to allow the projection 134 to pass into the slot 148. When the projection 134 travels past the engagement portion 164, the coil spring 186 automatically moves the release member 156 back to the engaged position (FIG. 3) without the user having to manually move the release member 156. In the engaged position, the flat bottom 172 of the release member 156 contacts the projection 134 to couple the agitator 102 to the nozzle body 14, and thereby placing the agitator 102 back in an operable position for use with the tool 10.

Various features and advantages of the invention are set forth in the following claims.

What is claimed is:

1. A vacuum cleaner accessory tool for use with a vacuum cleaner, the vacuum cleaner operable to draw air through a suction hose to clean a surface, the accessory tool comprising:

a nozzle body configured to be coupled to the suction hose and defining a chamber;

an agitator having a first end portion and a second end portion rotatably supported within the chamber of the nozzle body, the agitator removably coupled to the nozzle body, a drive member coupled to the agitator;

a release member coupled to the nozzle body and slidable with respect to the nozzle body between an engaged position and a disengaged position; and an ejection mechanism including a biasing member and a movable member coupled to the biasing member such that the biasing member biases the movable member, wherein in the engaged position, the release member engages the second end portion of the agitator to couple the agitator to the nozzle body within the chamber, and wherein in the disengaged position, the release member allows the agitator to be removed from the chamber of the nozzle body, wherein the biasing member biases the movable member to contact a portion of the agitator to bias the agitator out of the chamber of the nozzle body when the release member is in the disengaged position.

2. The accessory tool of claim 1, wherein the release member includes an actuation portion and an engagement portion, wherein the engagement portion contacts the second end portion of the agitator to retain the agitator in an operable position so that the agitator is drivable by the drive member, wherein the actuation portion is operable to move the engagement portion out of contact with the second end portion of the agitator to allow the agitator to be removed from the chamber.

3. The accessory tool of claim 2, wherein the release member is integrally formed as a single component.

4. The accessory tool of claim 2, wherein the nozzle body includes a side wall having an aperture, wherein the actuation portion of the release member is accessible through the aperture of the side wall to slide the release member to the disengaged position.

5. The accessory tool of claim 2, wherein the engagement portion includes a cam surface, wherein contact between the second end portion of the agitator and the cam surface moves the release member toward the disengaged position when the agitator is being coupled to the nozzle body.

6. The accessory tool of claim 5, wherein the nozzle body defines a slot having an open end, wherein the second end portion includes a projection, wherein the projection is received through the open end of the slot, wherein the projection contacts the cam surface of the release member as the projection is being moved along the slot to force the release member into the disengaged position, the accessory tool further comprising a biasing member configured to move the release member from the disengaged position to the engaged position when the projection travels within the slot past the engagement portion of the release member.

7. The accessory tool of claim 1, wherein the nozzle body includes a slot that receives the second end portion of the agitator, wherein the release member extends into the slot in the engaged position to retain the agitator in an operable position so that the agitator is drivable by the drive member.

8. The accessory tool of claim 7, wherein the release member does not extend into the slot when the release member is in the disengaged position to allow the second end portion of the agitator to slide along the slot and out of the slot.

9. The accessory tool of claim 7, wherein at least a portion of the ejection mechanism is positioned in the slot.

10. The accessory tool of claim 1, wherein the nozzle body includes an inner wall disposed within the nozzle body and an outer wall that defines an outer surface of the nozzle body, wherein the release member is in sliding contact with the inner wall and the outer wall and between the inner wall and the outer wall.

11. The accessory tool of claim 1, wherein the release member remains coupled to the nozzle body in both the engaged and the disengaged positions.

12. The accessory tool of claim 1, wherein the movable member is a slide.

13. The accessory tool of claim 1, wherein the movable member is a slide and wherein the ejection mechanism further includes a base having an aperture, wherein the biasing member is positioned within the base and the slide extends through the aperture in the base to bias the agitator out of the chamber of the nozzle body.

14. A vacuum cleaner accessory tool for use with a vacuum cleaner, the vacuum cleaner operable to draw air through a suction hose to clean a surface, the accessory tool comprising:

a nozzle body configured to be coupled to the suction hose and defining a chamber, the nozzle body defining a slot having an open end;

an agitator having a first end portion and a second end portion rotatably supported within the chamber of the nozzle body, the second end portion including a projection that is received through the open end of the slot to couple the agitator to the nozzle body, the agitator removably coupled to the nozzle body;

a drive member coupled to the agitator and operable to rotate the agitator;

a release member slidable with respect to the nozzle body between an engaged position and a disengaged position, the release member including a cam surface;

a biasing member coupled to the release member and configured to bias the release member toward the engaged position, wherein in the engaged position, the release member is coupled to the nozzle body and retains the agitator in an operable position so that the agitator is drivable by the drive member, wherein in the disengaged position, the release member is coupled to the nozzle body and the second end portion of the agitator is movable with respect to the nozzle body to uncouple the agitator from the nozzle body, and wherein the projection of the agitator directly contacts the cam surface of the release member as the projection is being moved into the slot through the open end to force the release member into the disengaged position, wherein the biasing member moves the release member from the disengaged position to the engaged position when the projection travels within the slot past the cam surface and the open end, and wherein the release member extends into the slot when in the engaged position to retain the agitator in the operable position.

15. The accessory tool of claim 14, wherein the release member contacts the second end portion of the agitator to retain the agitator in the operable position.

16. The accessory tool of claim 15, wherein the release member generally does not contact the agitator when the release member is in the disengaged position.

17. The accessory tool of claim 14, wherein the release member is integrally formed as a single component.

18. The accessory tool of claim 14, wherein the release member does not extend into the slot when the release member is in the disengaged position.

19. The accessory tool of claim 14, wherein the nozzle body includes a bottom wall, a top wall, a first side wall that couples the top wall and the bottom wall, and a second side wall that couples the top wall and the bottom wall opposite the first side wall, the accessory tool further comprising, a suction inlet opening that extends through the bottom wall, the suction inlet opening configured to draw air therethrough, and wherein the first side wall includes an aperture, and wherein the release member is manually accessible through the aperture of the first side wall to move the release member from the engaged position to the disengaged position.

20. The accessory tool of claim 14, wherein the nozzle body includes an inner wall disposed within the nozzle body and an outer wall that defines an outer surface of the nozzle body, wherein the release member is in sliding contact with the inner wall and the outer wall and between the inner wall and the outer wall.

* * * * *